US007261268B2

(12) United States Patent
Kunesh et al.

(10) Patent No.: US 7,261,268 B2
(45) Date of Patent: Aug. 28, 2007

(54) WALL MOUNTABLE HOLDER FOR A CONTAINER

(75) Inventors: Edward J. Kunesh, Franksville, WI (US); David P. Mather, Milwaukee, WI (US); Allen D. Miller, Racine, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 211 days.

(21) Appl. No.: 10/868,151

(22) Filed: Jun. 15, 2004

(65) Prior Publication Data

US 2005/0274860 A1 Dec. 15, 2005

(51) Int. Cl.
*A47F 5/00* (2006.01)
*A47K 1/08* (2006.01)

(52) U.S. Cl. ..... 248/310; 248/311.2; 206/228

(58) Field of Classification Search ..... 248/311.3, 248/310, 314, 213.2, 311.2, 315, 309.1, 205.5, 248/206.3, 312; 221/181.3, 199; 222/192, 222/181.1, 160, 162; 206/228
See application file for complete search history.

(56) References Cited

U.S. PATENT DOCUMENTS

| | | | | | |
|---|---|---|---|---|---|
| 3,228,609 | A | * | 1/1966 | Edelstein et al. | 239/70 |
| 3,288,332 | A | | 11/1966 | Etter et al. | 222/80 |
| 3,368,720 | A | | 2/1968 | Moll | 222/181 |
| 3,444,990 | A | * | 5/1969 | Braginetz | 206/228 |
| 3,653,554 | A | | 4/1972 | Turben | 222/181 |
| 3,814,297 | A | | 6/1974 | Warren | 222/402.13 |
| 4,223,812 | A | | 9/1980 | van Lit | 222/180 |
| 4,678,106 | A | | 7/1987 | Newell et al. | 222/162 |
| 4,792,064 | A | | 12/1988 | Loesel, Jr. et al. | 222/181 |
| 4,889,141 | A | * | 12/1989 | Lindsey | 132/286 |
| 4,905,873 | A | | 3/1990 | Loesel, Jr. et al. | 222/181 |
| 4,957,260 | A | * | 9/1990 | Shelley | 248/311.3 |
| 5,014,880 | A | | 5/1991 | Loesel, Jr. et al. | 222/181 |
| 5,228,601 | A | | 7/1993 | Podesta | 222/181 |
| 5,431,304 | A | | 7/1995 | Gentile | 222/103 |
| 5,443,236 | A | | 8/1995 | Bell et al. | 248/311.3 |
| 5,445,288 | A | | 8/1995 | Banks | 222/95 |
| 5,755,415 | A | * | 5/1998 | Sorg | 248/213.2 |
| 5,782,346 | A | * | 7/1998 | Gray et al. | 206/228 |
| 5,826,755 | A | | 10/1998 | Burd | 222/309 |
| D401,145 | S | * | 11/1998 | Gray | D9/749 |
| 5,992,708 | A | | 11/1999 | Gaichuk | 222/402.15 |
| 6,073,533 | A | | 6/2000 | Brandon | 86/45 |
| 6,237,812 | B1 | | 5/2001 | Fukada | 222/181.2 |
| 6,318,600 | B1 | | 11/2001 | Winnett et al. | 222/173 |
| 6,409,050 | B1 | | 6/2002 | Ophardt et al. | 222/181.1 |
| 6,481,599 | B1 | * | 11/2002 | DeVaux | 222/192 |
| 6,581,804 | B1 | | 6/2003 | Ciavarella et al. | 222/181.3 |
| D477,956 | S | | 8/2003 | Grisdale et al. | D6/553 |
| 6,601,736 | B2 | | 8/2003 | Ophardt et al. | 222/181.1 |
| 6,637,707 | B1 | * | 10/2003 | Gates et al. | 248/224.7 |
| 2003/0136800 | A1 | | 7/2003 | Brand et al. | 222/183 |
| 2004/0188470 | A1 | | 9/2004 | Hill | 222/192 |
| 2005/0193573 | A1 | * | 9/2005 | Lukan et al. | 30/541 |

* cited by examiner

*Primary Examiner*—Carl D. Friedman
*Assistant Examiner*—Tan Le

(57) ABSTRACT

A holder for a replaceable container of product includes a wall mountable support member having a longitudinal dimension. A holding sleeve extends transversely to the longitudinal dimension a first distance from a first region of the support member. The holding sleeve defines a bulbous recess. A foot extends transversely to the longitudinal dimension a second distance from a second region of the support member. The second distance is less than the first distance. The foot is spaced from the holding sleeve.

25 Claims, 13 Drawing Sheets

WALL MOUNTABLE HOLDER FOR A CONTAINER

CROSS REFERENCE TO RELATED APPLICATIONS

Not applicable

REFERENCE REGARDING FEDERALLY SPONSORED RESEARCH OR DEVELOPMENT

Not applicable

SEQUENTIAL LISTING

Not applicable

BACKGROUND OF THE INVENTION

1. Field of the Invention

The present invention relates generally to holding apparatus, and more particularly to a device that holds a container.

2. Description of the Background of the Invention

Various holders for containers, such as aerosol containers, have been developed. Brand et al. U.S. 2003/0136800 discloses an inhaler housing for an aerosol canister that contains an asthma medicine. A collar is fitted around the canister. The canister is placed within a sleeve of the housing in an inverted position, and the sleeve is joined to the collar 40 to prevent lateral movement of the canister within the sleeve.

Ciavarella et al. U.S. Pat. No. 6,581,804 discloses a wall mounted container housing. A support plate of the housing is mounted to a wall. A container is placed in the housing in an inverted position and is maintained in the housing in a position slightly canted or tilted from vertical in a direction toward the wall. Pushing on a surface of the housing presses part of the housing against a valve stem of the container, thereby tilting the valve stem and allowing product to flow out of the container into a user's hand.

Winnett et al. U.S. Pat. No. 6,318,600 discloses a wall mounted dispenser that accommodates shaving cream cans of differing height and diameter. A can is placed within the dispenser in an upright position, and a handle of the dispenser is depressed by a user's finger, thereby discharging shaving cream into the hand of the user.

Fukada U.S. Pat. No. 6,237,812 discloses a wall mounted housing having a hinged cover. Upon placement of an aerosol container in an inverted position within the housing, the hinged cover is closed, thereby enclosing the container entirely. A valve stem is disposed at an outlet end of the container, and the container is supported by a U-shaped support arm or ledge. Pushing a pushbutton on a lower part of the cover tilts the valve stem to dispense a disinfectant.

Burd U.S. Pat. No. 5,826,755 discloses a container of liquid soap disposed in an inverted position within a dispenser. A lower portion of the dispenser holds part of the container and includes a pump and a pump handle. The pump utilizes check valves that convert reciprocations of the pump and the pump handle into a pressure stroke and a return stroke.

Banks U.S. Pat. No. 5,445,288 discloses a foaming device. A collapsible and gusseted container of liquid is placed within the device in an inverted position. A foam producing pump causes foaming of the liquid as the liquid is dispensed.

FIG. 4 of Loesel et al. U.S. Pat. No. 4,905,873 shows a bracket mounted to a wall and a protruding means on a lower part thereof. A flexible soap bladder is fitted within an upper portion of the bracket, and the bladder is pivoted about the bracket in a direction toward the protruding means, thereby pressing the bladder against the protruding means to dispense soap.

SUMMARY OF THE INVENTION

In accordance with one aspect of the present invention, a holder for a replaceable container of product includes a wall mountable support member having a longitudinal dimension and a holding sleeve extending transversely to the longitudinal dimension a first distance from a first region of the support member. A foot extends transversely to the longitudinal dimension a second distance from a second region of the support member wherein the second distance is less than the first distance and wherein the foot is spaced from the holding sleeve.

According to a further aspect of the present invention, a holder in combination with a replaceable container of product comprise a wall mountable support member having a longitudinal dimension and a holding sleeve extending transversely to the longitudinal dimension a first distance from a first region of the support member. A foot extends transversely to the longitudinal dimension a second distance from a second region of the support member wherein the second distance is less than the first distance and wherein the foot is spaced from the holding sleeve. An outlet end of the container is adjacent and engageable with the foot to open an outlet valve of the container and a further end of the container opposite the outlet end is received by the holding sleeve.

Other aspects and advantages of the present invention will become apparent upon consideration of the following detailed description.

DETAILED DESCRIPTION OF THE PREFERRED EMBODIMENTS

Figure 1:
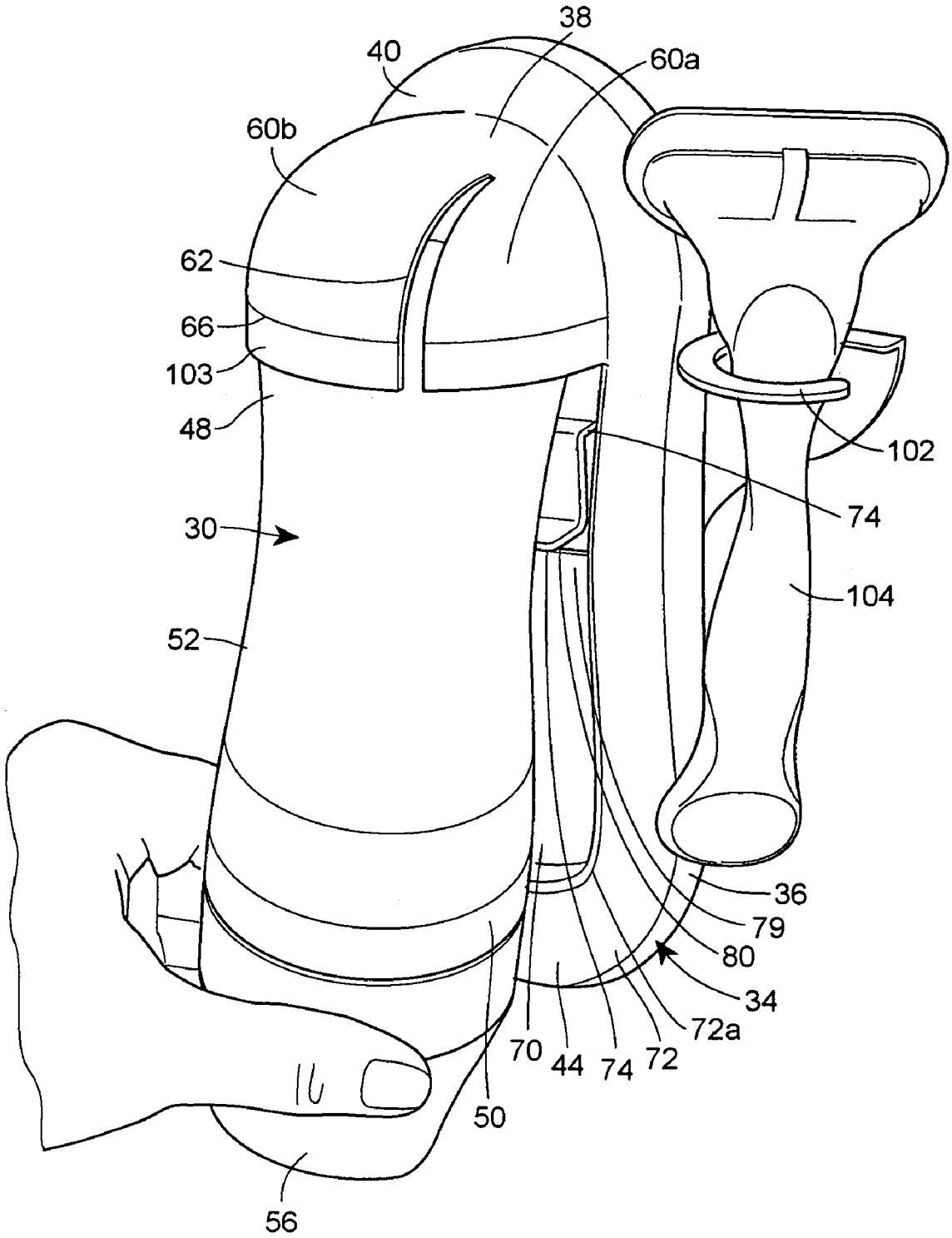
FIG. 1 is an isometric and diagrammatic view of a container partially installed into a holder according to the present invention.
Figure 2:
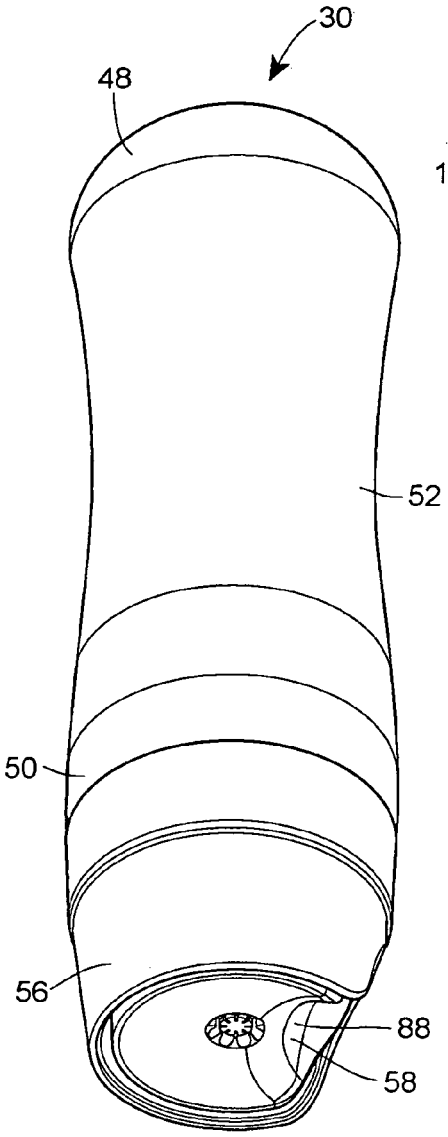
FIG. 2 is an isometric view of the container of FIG. 1.
Figure 3:
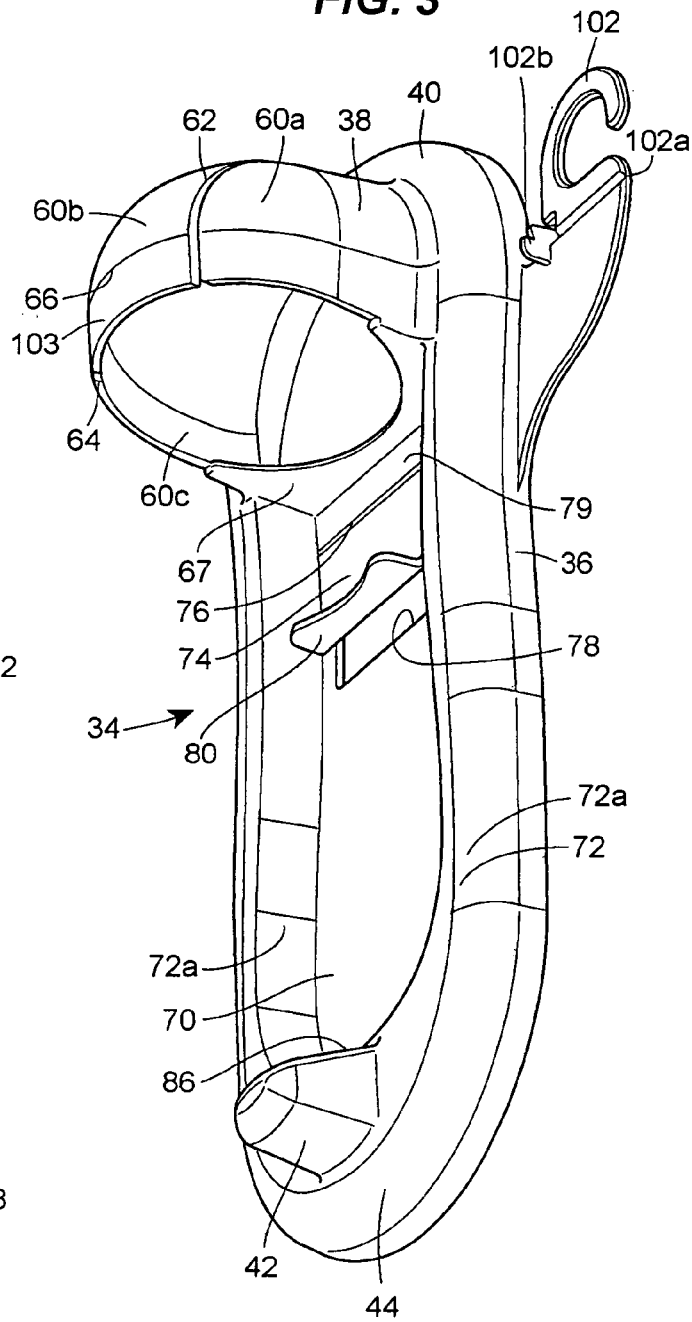
FIG. 3 is an isometric view of the holder of FIG. 1.
Figure 5:
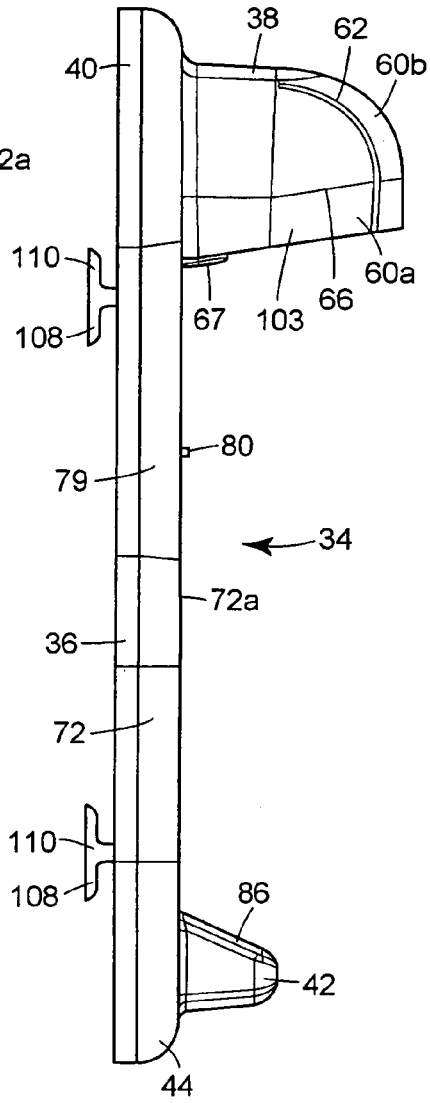

Referring to FIGS. 1-3, a container 30 is insertable into and capable of being held and supported by a holder 34. The holder 34 includes a wall mountable support member 36 having a longitudinal dimension, a holding sleeve 38 extending a first distance from a first region 40 of the support member 36 in a direction transverse to the longitudinal dimension, and a foot 42 extending a second distance from a second region 44 of the support member 36 also in a direction transverse to the longitudinal dimension. The foot 42 is spaced from the sleeve 38 along the longitudinal direction. Referring also to FIG. 5, the foot 42 extends from the member 36 a lesser distance than the sleeve 38. Referring to FIGS. 2 and 9, the container 30 includes first and second bulbous ends 48, 50 (the second end 50 is also referred to as an outlet end hereinafter), a middle portion 52, a valve stem 54 (FIG. 8), and an actuator cap 56 fitted over the valve stem 54. A pushbutton 58 is mounted on the valve stem 54 and can be manipulated to dispense product from the container 30. The container 30 is placed within the holder 34 in an inverted position with the first bulbous end 48 retained within the sleeve 38. The second bulbous end 50 is disposed adjacent the foot 42 such that the pushbutton 58 can be displaced into contact with the foot 42. Once the end 48 is installed within the sleeve 38, a user dispenses product from the container 30 by pressing the container 30 toward the support member 36, thereby pressing the pushbutton 58 of the container 30 against the foot 42. This action, in turn, displaces the valve stem 54 thereby causing product to dispense from the second or outlet end 50 of the container 30 into the hand of the user. The product may be any of a variety of suitable products, and in particular may be a liquid, gel, or foam shave product.

Figure 4:
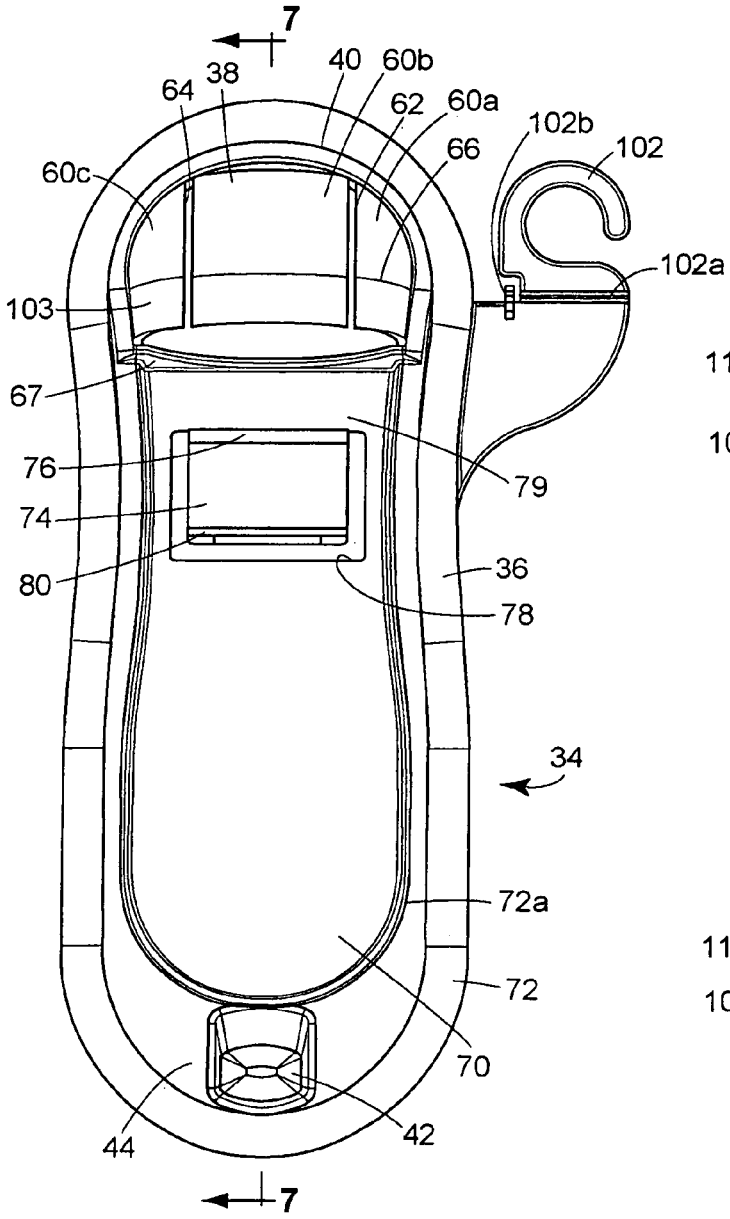
FIGS. 4, 5, and 6 are front, side, and rear elevational views of the holder of FIG. 1, respectively.

Referring to FIGS. 3-8, the sleeve 38 may optionally be defined in part by a first wall portion 60*a* and a second wall portion 60*b* that together define a slit 62 therebetween. Referring to FIGS. 3 and 4, the sleeve 38 may further include a third wall portion 60*c* adjacent the second wall portion 60*b* that defines a further slit 64 between the portions 60*b*, 60*c*. The slits 62, 64 facilitate flexing of the sleeve 38 as the bulbous end 48 is inserted into the sleeve 38. The sleeve 38 has an axial dimension parallel to the longitudinal dimension of the support member 36, and a varying width dimension transverse to the axial dimension. More particularly, the sleeve 38 as shown defines a bulbous, approximately hemispherical recess that terminates just below a line 66 and which receives the bulbous end 48. If desired, the sleeve 38 could alternatively define a recess of different geometry but nonetheless having a varying width dimension. For example, the recess could have a triangular or other shape in longitudinal cross section, and a triangular-shaped end (or other shaped end, not shown) of a complementary container could be inserted into such recess. While the recess and the end of the container may have different shapes from one another, the illustrated bulbous shape of the sleeve 38 allows the interior surface of the sleeve 38 to contact much of the surface area of the bulbous end 48, thereby providing a sufficient grip on the end 48 and maintaining the container 30 within the sleeve 38 despite a user pressing the container 30 against the foot 42 to dispense product. In addition, the sleeve 38 conforms aesthetically to the shape of the container 30. Referring to FIG. 3, an arcuate wall portion 67 may optionally be provided. The wall portion 67 extends from the holder 34 transversely to the axial dimension, and the wall portion 67 provides additional surface area for gripping the container 30 adjacent the first bulbous end 48.

Figure 7:
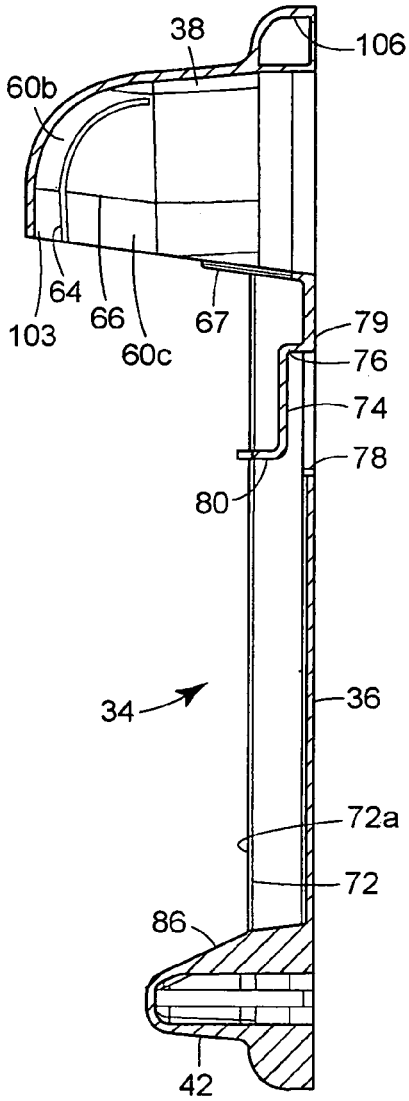
FIG. 7 is a sectional view generally taken along the lines 7-7 of FIG. 4.

FIG. 3 shows an internal or base wall 70 of the support member 36 surrounded by a peripheral wall 72 of the support member 36. The base wall 70 is recessed from a surface 72*a* of the peripheral wall 72. A flexible tab 74 may be connected to the base wall 70 at a hinge region 76 of the tab 74. The base wall 70 has a portion defining a window 78 that allows flexing of the tab 74 about the hinge region 76. A ledge 80 of the tab 74 extends transversely to the longitudinal dimension of the holder 34 and further extends from the support member 36 a lesser distance than the holding sleeve 38, as best seen in FIGS. 5 and 7. The tab 74 extends from a region 79 of the support member 36 intermediate the first and second regions 40, 44. The tab 74 may be provided to space the container 30 from the support member 36 and acts as a resilient member to bias the container 30 away from the foot 42. The tab 74 may also act as a fulcrum promoting the end 50 (FIG. 1) of the container 30 to bear against the foot 42 when the container 30 is pushed. The flexibility afforded by the tab 74 allows the holder 34 to accommodate a range of pushing force on the container 30 without the container 30 popping loose from the sleeve 38 while still spacing the container 30 from the support member 36.

The foot 42 may have any suitable shape and size. For example, the foot 42 may have a substantially trapezoidal shape in cross section defining a sloped surface 86. The sloped surface 86 is advantageous in terms of fitting against a sloped surface 88 (FIGS. 2, 12, 14) defined by the pushbutton 58 of the actuator cap 56. Thus, the sloped surface 86 provides a suitably shaped complementary surface for the sloped surface 88 of the pushbutton 58. In addition, the sloped surface 86 could optionally be adapted to support at least some of the weight of the container 30, which could be useful in terms of maintaining the container 30 within the sleeve 38 as the container 30 is pushed. Optionally, the foot 42 may be molded or otherwise manufactured integrally with the holder 34, or the foot 42 may be separately manufactured from the rest of the holder 34.

The holder 34 may further include a holding receptacle 102 extending from the peripheral wall 72. Referring to FIG. 1, the holding receptacle 102 may conveniently hold a shaving razor 104. Referring to FIGS. 3 and 4, the holder 34 may include a hinged portion 102*a* about which the receptacle 102 is pivotable. The receptacle 102 may be pivoted downwardly to the position of FIG. 1, at which position the receptacle 102 rests upon a ledge 102*b* (seen in FIG. 3). The ledge 102*b* stops further downward pivoting movement of the receptacle 102 that might otherwise result from the weight of the razor 104.

Figure 6:
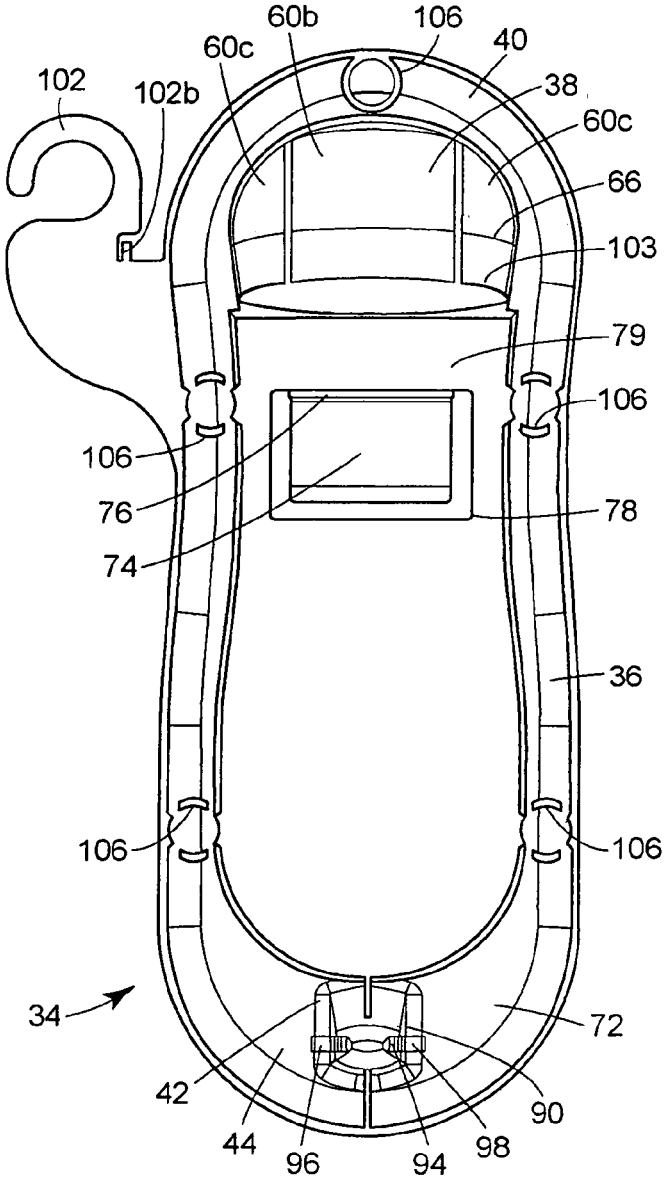
Figure 8:
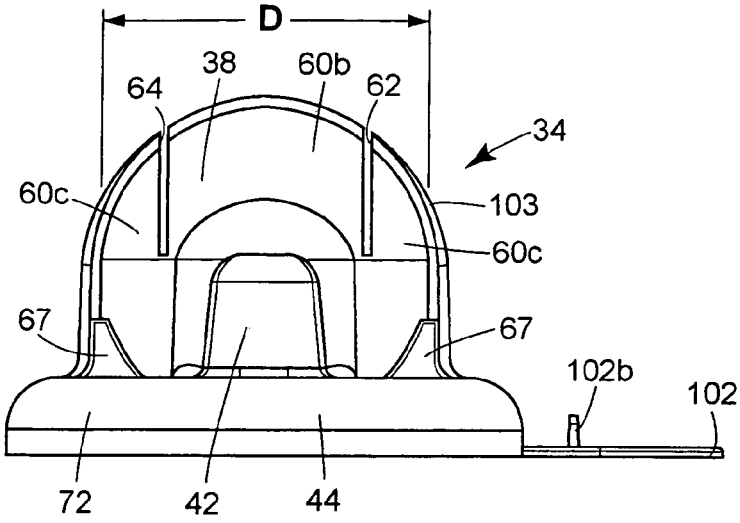
FIG. 8 is a bottom elevational view of the holder of FIG. 1.
Figure 9:
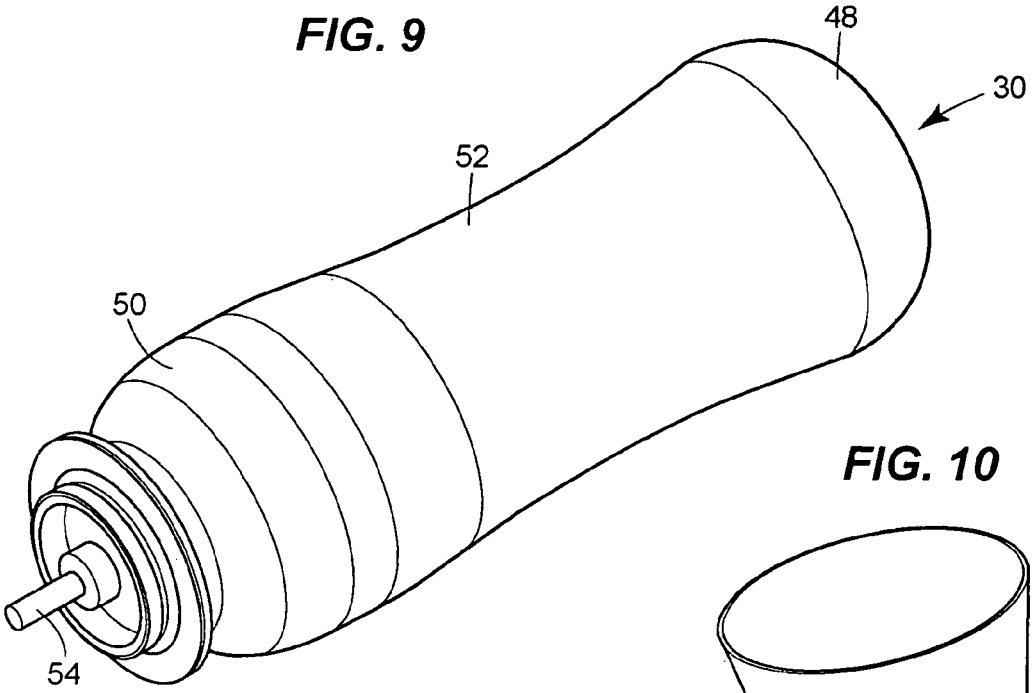
FIG. 9 is an isometric view of the of the container of FIG. 1 with an actuator cap thereof removed.

Referring to FIG. 8, a lower portion 103 of the sleeve 38 defines a diameter D sized to grip the container 30 below the bulbous end 48. Referring to FIGS. 6 and 7, the holder 34 may be provided with a plurality of cylindrical recesses 106. FIG. 5 shows mounting elements 108 mounted within the recesses 106 such as by a snap fit, an interference fit, adhesive, or other suitable means of attachment. The mounting elements 108 are mountable to a wall, such as a bathroom shower wall or a mirror. The mounting elements 108 may be suction cups 110. However, the mounting elements 108 could be any of a wide variety of mounting elements such as screws or other suitable fasteners. The suction cups 110 are particularly preferred because these do not typically damage or require alteration of a wall surface.

Figure 10:
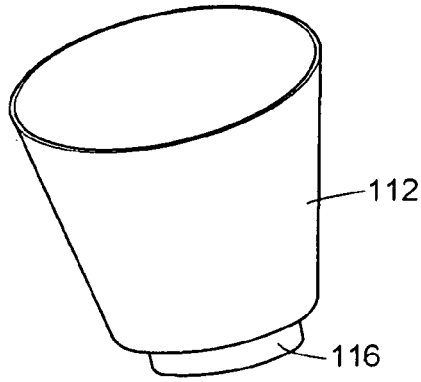
FIG. 10 is an isometric view illustrating a cover that may be used to cover the actuator cap of the container of FIG. 1.
Figure 11:
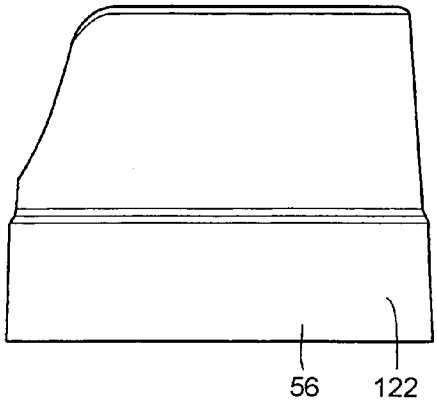
FIGS. 11 and 12 are side elevational and isometric views of the actuator cap of FIG. 1, respectively.

Referring now to FIG. 10, an overcap 112 may be provided, which may be placed over the actuator cap 56 to cover the actuator cap 56 during storage or transport of the container 30. The overcap 112 may have a shape that is fully or partially complementary to the rounded shape of the actuator cap 56. The overcap 112 may be provided with a planar circumferential flange 116 for upright storage of the container 30 on a shelf, countertop, or the like. When a user wishes to use the container 30, the user may remove the overcap 112 and then insert the bulbous end 48 of the container 30 into the sleeve 38 of the holder 30 as seen in FIG. 1.

Figure 13:
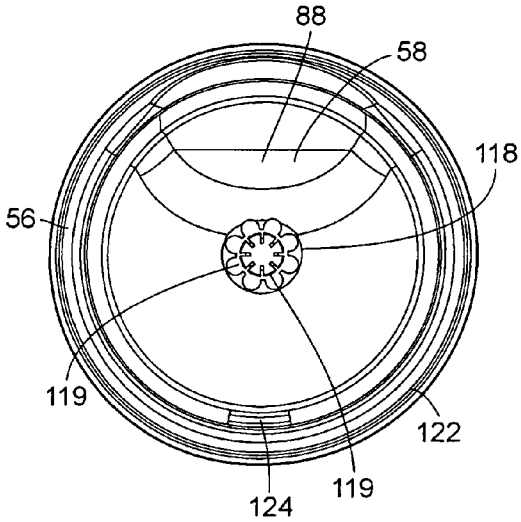
FIG. 13 is a plan view of the actuator cap of FIG. 1.
Figure 14:
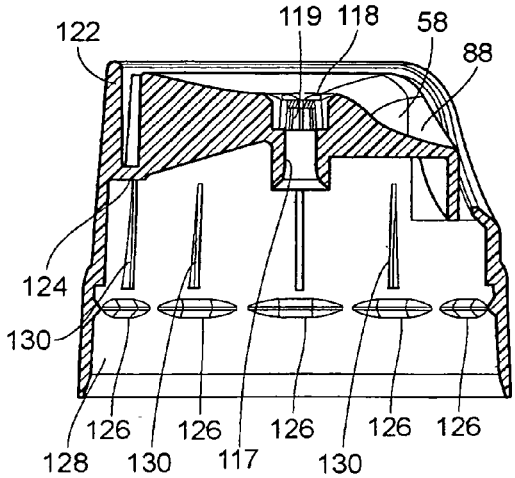
FIG. 14 is a sectional view taken generally along the lines 14-14 of FIG. 12.

Referring to FIG. 14, the actuator cap 56 includes wall(s) 117 defining a conduit that wherein the wall(s) 117 fit over the valve stem 54. The conduit 117 terminates at an opening 118 at which product is discharged. Referring to FIG. 13, the wall(s) 117 may include a plurality of lands 119 extending into the flow path of the product. The lands 119 may contribute to enhancing the foaming action of a shave product stored in the container 30.

Figure 12:
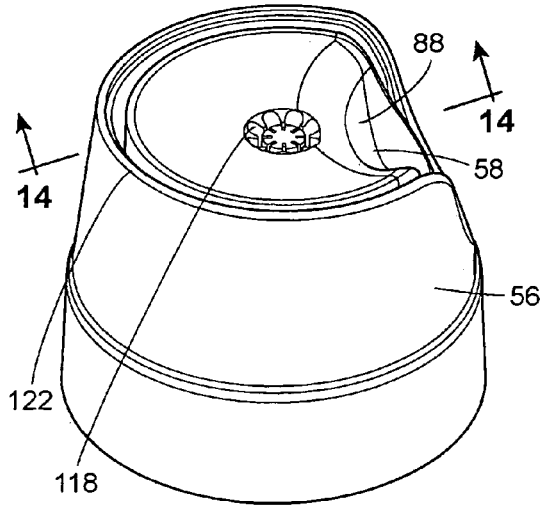

Referring to FIGS. 12-14, the pushbutton 58 is hingedly connected to a stationary outer portion 122 of the actuator cap 56. Specifically, the pushbutton 58 is pivotable about a hinge portion 124 that connects the portions 58, 122. The hinge portion 124 is resilient to bias the pushbutton 58 upwardly. The wall(s) 117 transfer the movement of the pushbutton 58 to the valve stem 54 (seen in FIG. 9), thereby actuating the valve stem 54 and dispensing product from the opening 118. The valve stem 54 may be of any suitable type, whether substantially vertically reciprocating or of a tilting variety.

Referring to FIG. 14, a circumferential interrupted bead may be defined by a plurality of spaced apart flanges 126, and such bead may snap fitted onto a suitably positioned undercut (not shown) of the container 30. Alternatively, a base 128 of the actuator cap 56 may be sealed onto the bulbous end 50 of the container 30 at a suitable position. The cap 56 may further include a plurality of stiffening ribs 130 to enhance the rigidity of the cap 56.

The holder 34 offers the advantage of one-handed dispensing from the container 30. One-handed dispensing may be particularly convenient in a shower environment where, for example, the user may be holding the razor 104 (FIG. 1) in one hand. The inverted position of the container 30 may provide an advantage for containers that do not include a dip tube but instead rely on pressurized gas maintained within an upper end of the container such as the end 48. In this regard, spherical walls such as the bulbous ends 48, 50 may be highly effective in terms of storing pressurized gas. The bulbous sleeve 38 is particularly well suited for holding the bulbous end 48.

Figure 15:
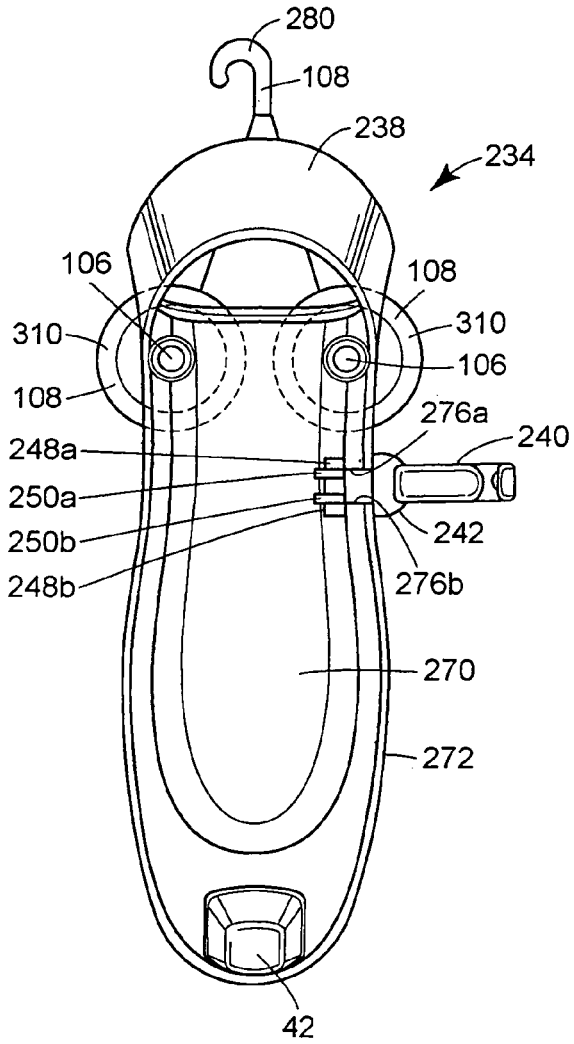
FIGS. 15 and 16 are front and side elevational views of another embodiment of the holder of the present invention, respectively.
Figure 16:
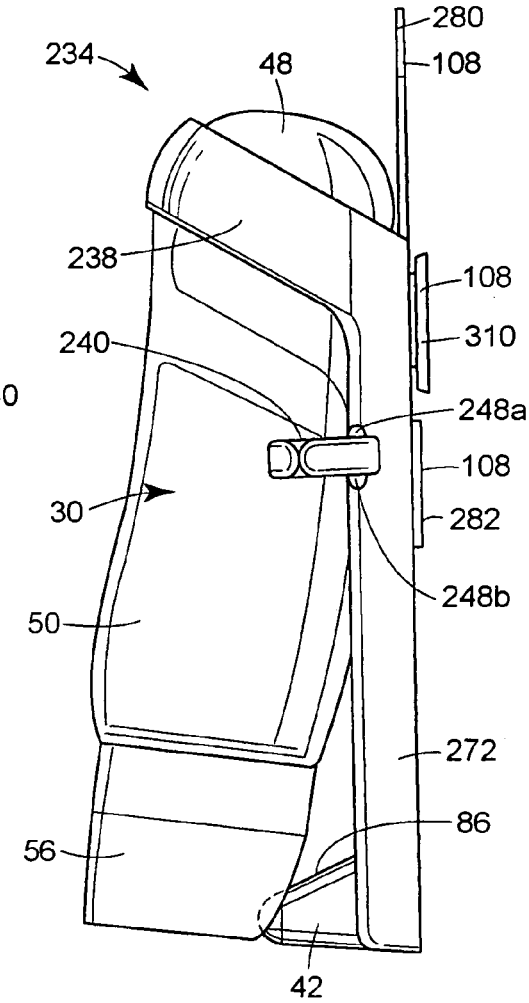

Referring to FIGS. 15 and 16, a holder 234 includes a sleeve 238 that functions in a manner similar to the sleeve 38 (FIG. 1). However, the sleeve 238 does not include slits or provide a closed concave recess like the sleeve 38. In this regard, the sleeve 238 has a curved inner surface like the previous embodiment that fits around a portion of the bulbous end 48. The sleeve 238 may project from the support member 36 at any suitable angle such as approximately 120° as shown in FIG. 16.

A holding receptacle 240 may be secured in any convenient fashion to any portion of the holder 234. For example, referring to FIGS. 26-29, the receptacle 240 may have a cylindrical post 241, an intermediate portion 242 adjacent the post 241, and a gripping portion 246 adjacent the intermediate portion 242. The post 241 includes upper and lower extension portions 248*a*, 248*b* that are disposed behind upper and lower curved ribs 250*a*, 250*b* that are carried by one of both of a base wall 270 and peripheral wall 272. The intermediate portion 242 is notched to closely fit within a recess 274 formed in the peripheral wall 272. In this regard, the receptacle 240 may be made of a flexible thermoplastic or elastomeric material, such as thermoplastic rubber, to permit the intermediate portion 242 to be compressed between walls 276*a*, 276*b* defining the recess 274 so that the receptacle 240 is restrained against movement. The gripping portion 246 includes first and second arcuate legs 278*a*, 278*b* that define a circular cylindrical recess for receipt of an item, such as the razor 104. The legs 278*a*, 278*b* may be flexible, if desired, to securely grip a handle of the razor 104.

FIGS. 15 and 16 further illustrate an optional hanger member 280, which may be integral with or secured to remaining portions of the holder 234. The hanger member 280 facilitates suspension of the holder 234 from a structure, such as a hook, a shower head, or the like. The holder 234 (or any of the embodiments disclosed herein, for that matter) may alternatively or in addition have other securing means, such as one or more sections 282 of adhesive, double-sided adhesive tape, hook-and-loop type fasteners, or the like.

The holder 234 further differs from the holder 34 described above in that the holder 234 lacks the hinged tab 74 and the base wall 270 and peripheral wall 272 are curved and contoured as compared with the walls 70, 72. In addition, two securing means in the form of suction cups 310 are provided and the holding receptacle 102 is omitted.

With the foregoing exceptions, the holder 234 is otherwise identical to or substantially similar to the holder 34 of FIGS. 1 and 3-8 and functions identically thereto to hold a container for dispensing of product therefrom, such as the container 30 of FIGS. 1, 2, and 9-14.

Figure 17:
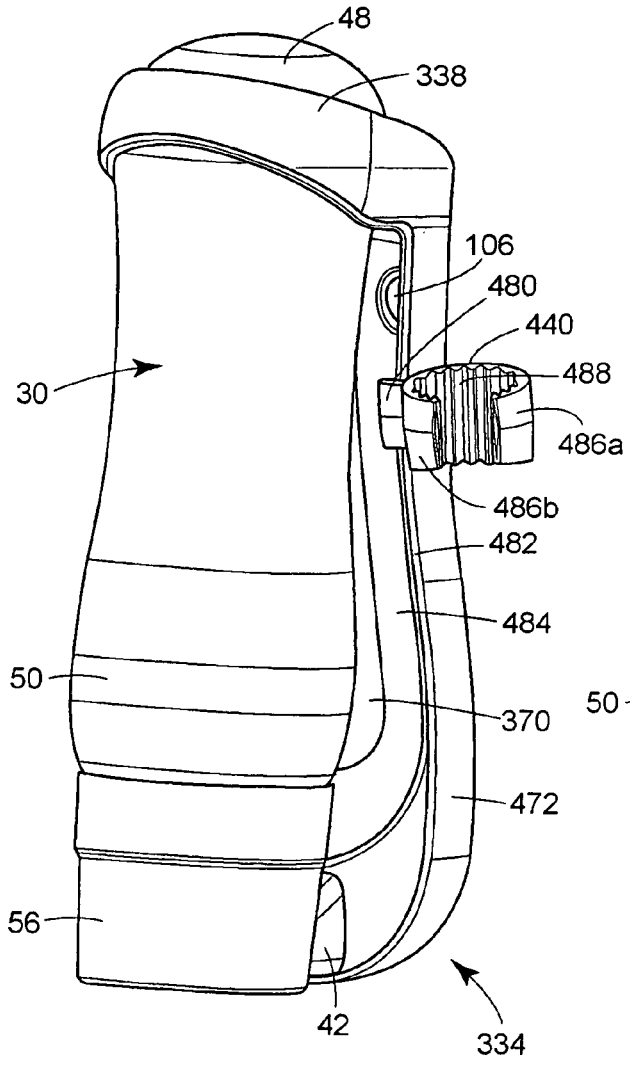
FIGS. 17 and 18 are isometric and front elevational views, respectively, of a holder with a container mounted therein according to a further embodiment of the present invention.
Figure 18:
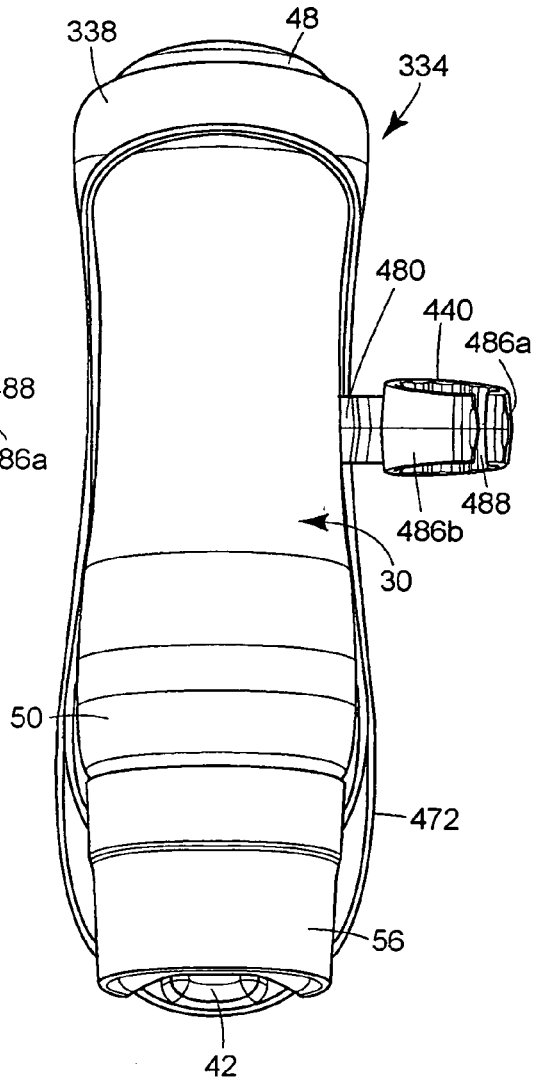
Figure 19:
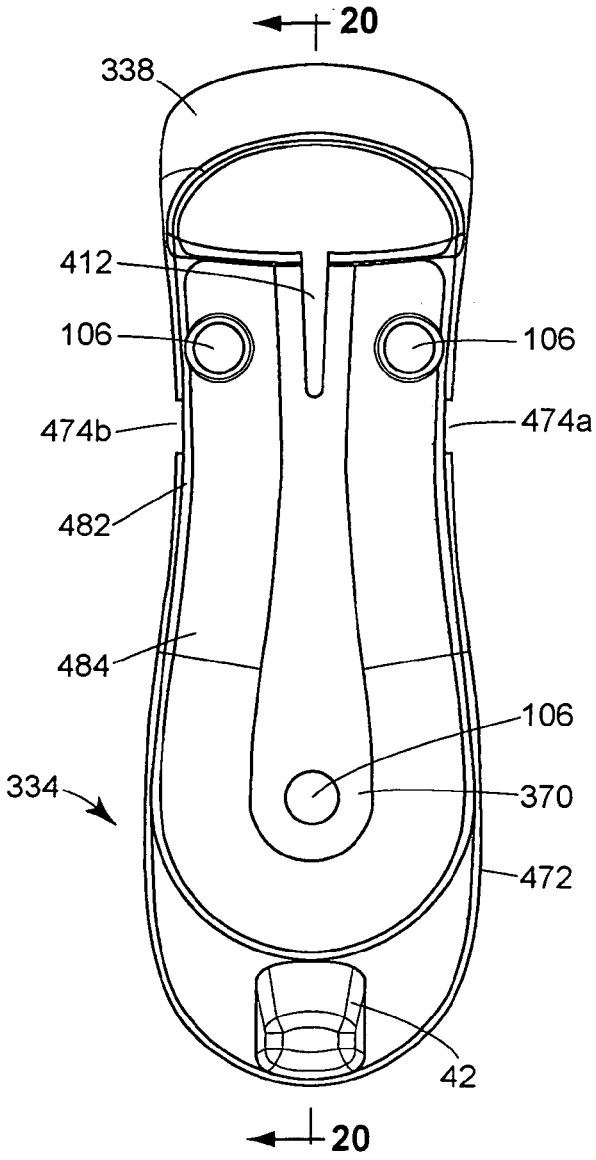
FIG. 19 is a front elevational view of the holder of FIGS. 17 and 18.
Figure 20:
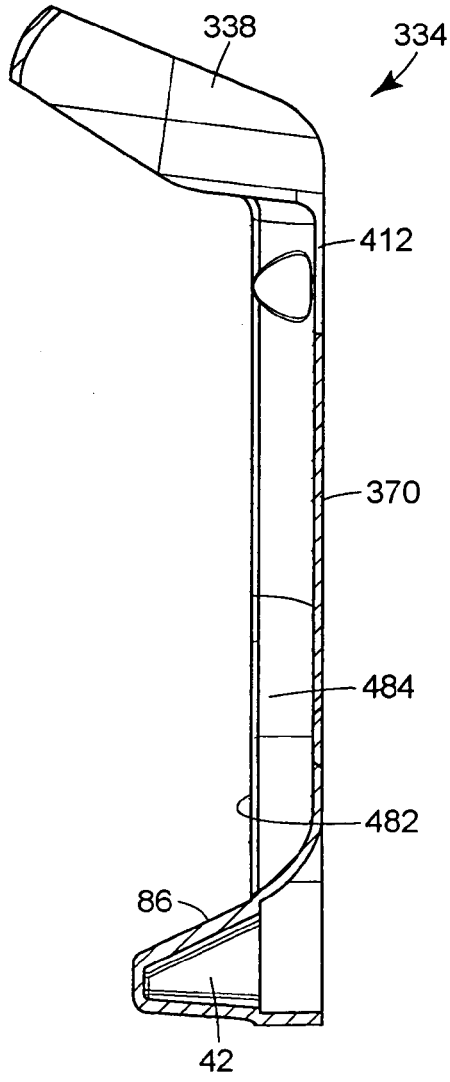
FIG. 20 is a sectional view of the holder taken generally along the lines 20-20 of FIG. 19.

FIGS. 17-22 illustrate a holder 334 according to a further embodiment of the present invention. The holder 334 is similar to the holder 234 described above except that the holder 334 includes a sleeve 338 that is generally of lesser longitudinal extent than the sleeve 238 (i.e., the sleeve 338 has a lesser top-to-bottom extent as seen in FIGS. 17 and 18). In addition, the holder 334 has three securing means in the form of suction cups 410 and the hanger member 280 is omitted. Still further, a compensating slot 412 is provided in a base wall 370 that permits the sleeve 338 to expand laterally in the event that a container of somewhat greater size is inserted therein, thus accounting for manufacturing tolerances of containers.

Figure 23:
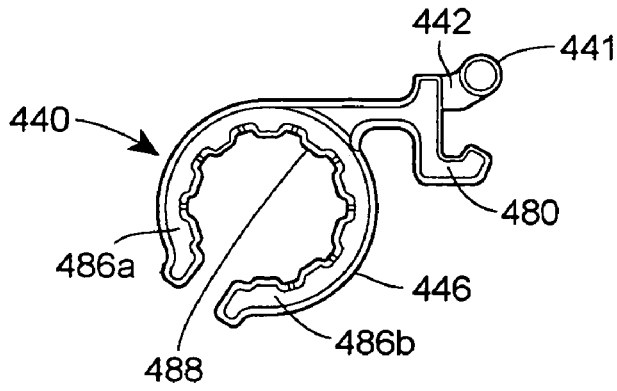
FIGS. 23 and 24 are end and side elevational views, respectively, of a holding receptacle that may be mounted on the embodiment of FIGS. 17-22.
Figure 24:
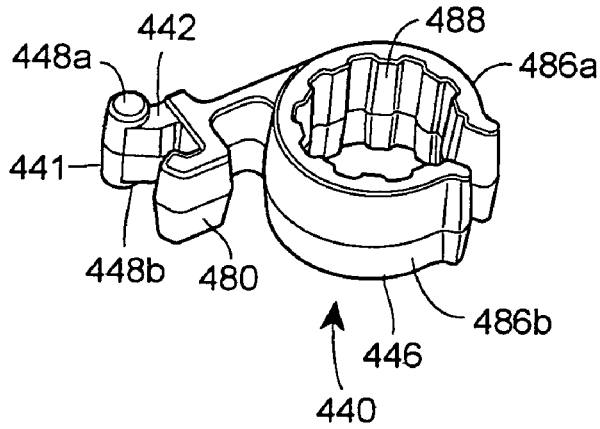
Figure 25:
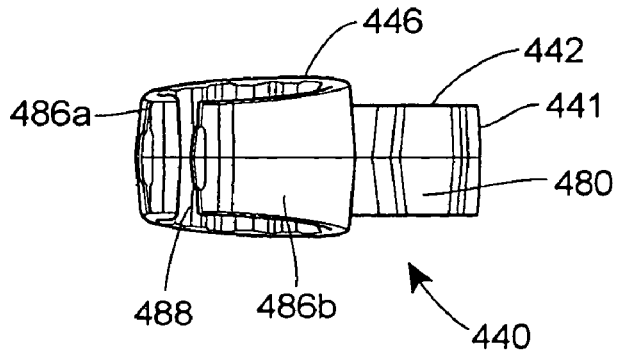
FIG. 25 is an isometric view of the holding receptacle of FIGS. 23 and 24.
Figure 26:
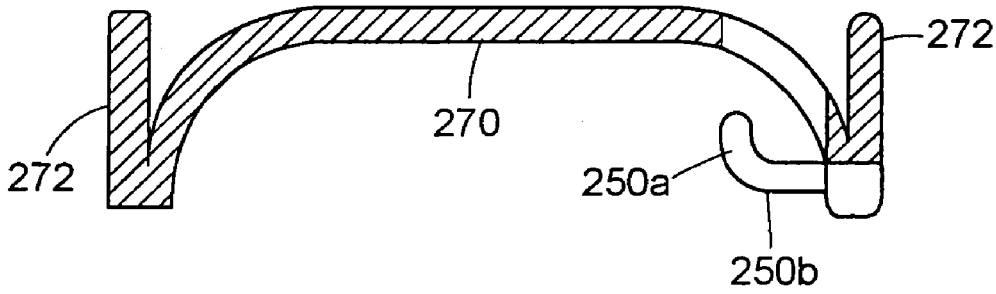
FIG. 26 is a sectional view taken generally along the lines 26-26 of FIG. 27.
Figure 27:
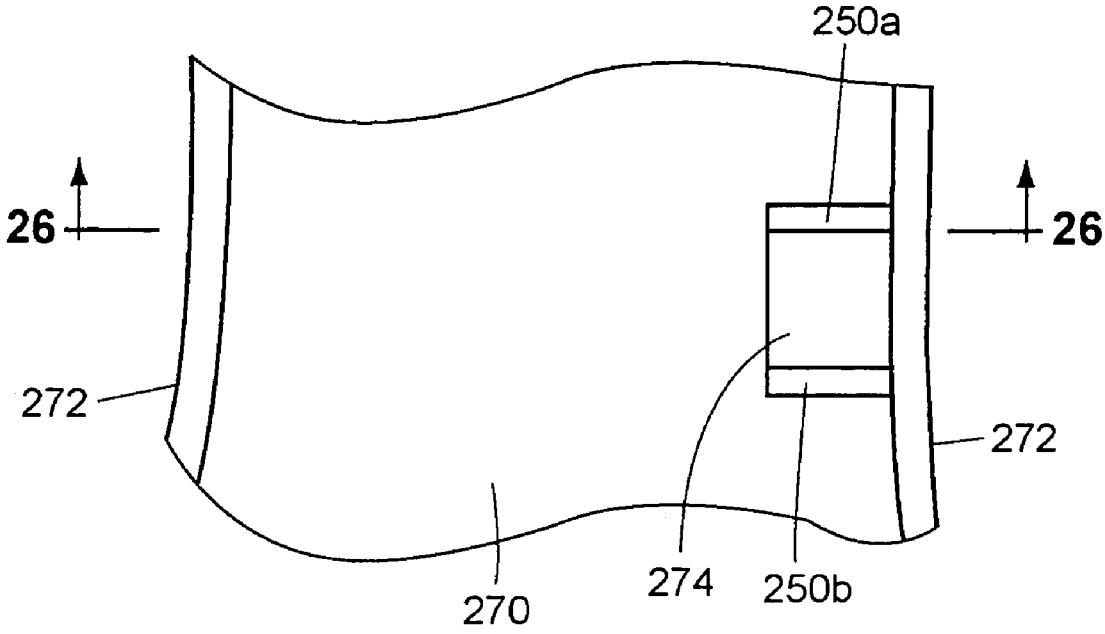
FIG. 27 a fragmentary rear elevational view of a portion of the holder of FIGS. 17 and 18 without a receptacle mounted thereto.
Figure 28:
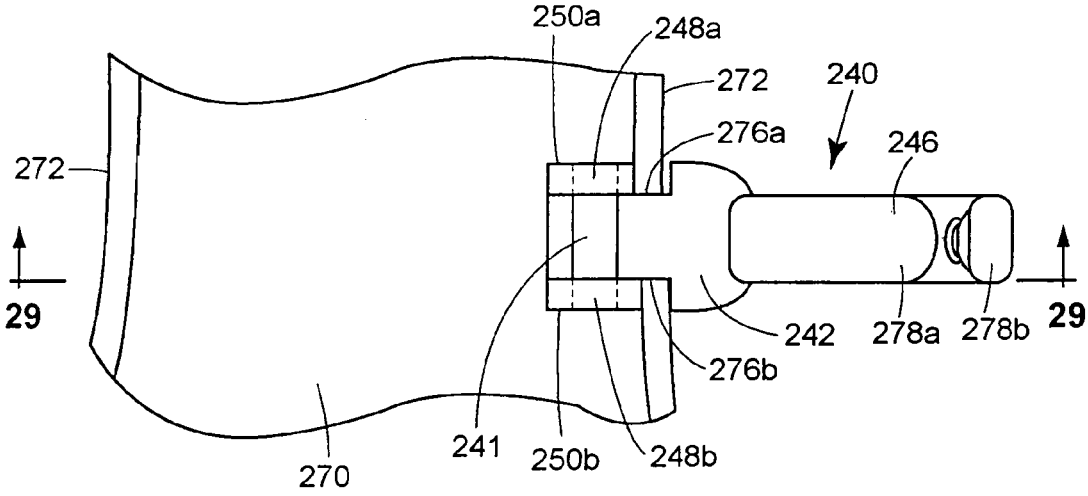
FIG. 28 is a fragmentary front elevational view of a portion of the holder of FIGS. 17 and 18 with a receptacle mounted thereto.
Figure 29:
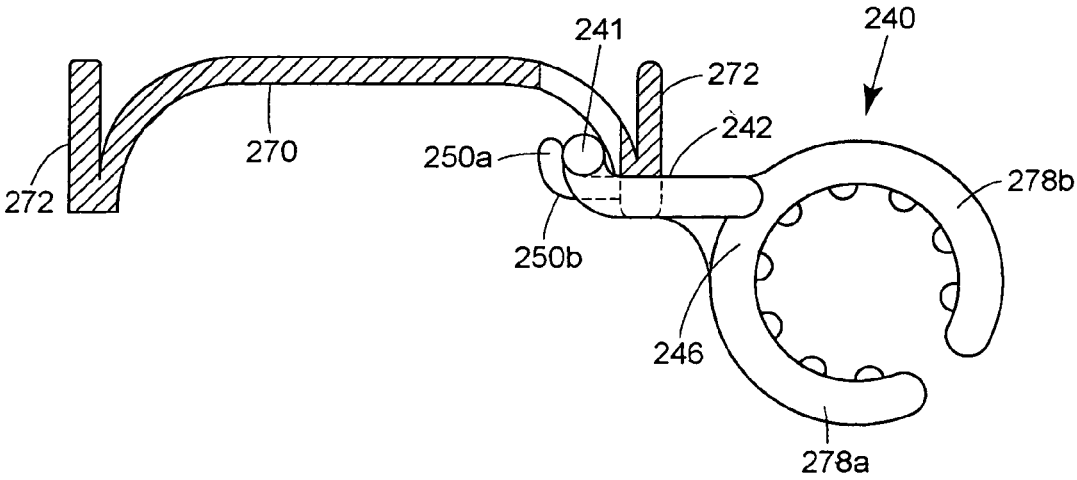
FIG. 29 is a sectional view of the holder taken generally along the lines 29-29 of FIG. 28 and showing the receptacle in full (i.e., non-sectional) view.

In addition to the foregoing, the holding receptacle 240 is omitted and an optional holding receptacle 440 may be mounted on either side of the holder 334. Specifically, and with reference to FIGS. 23-25, the holding receptacle 440 includes a post 441, an intermediate portion 442 adjacent the post 441, and a gripping portion 446 adjacent the intermediate portion 442. The post 441 includes upper and lower extension portions 448*a*, 248*b* that are disposed behind portions 450*a*, 450*b* of a side wall 472. The intermediate portion 242 is notched to closely fit within a first recess 474*a* formed in the side wall 472. In this regard, the receptacle 440 may be made of a flexible thermoplastic or elastomeric material, such as thermoplastic rubber, to permit the intermediate portion 442 to be compressed between walls 476*a*, 476*b* defining the recess 474*a* so that the receptacle 440 is restrained against movement. The intermediate portion 442 may further include a clip portion 480 that is hooked over a front edge 482 of a peripheral wall 484 to further restrain the receptacle 440 against movement. In this regard, the flexible nature of the material used to produce the receptacle 440 facilitates hooking of the clip portion 480 over the front edge 482.

Figure 21:
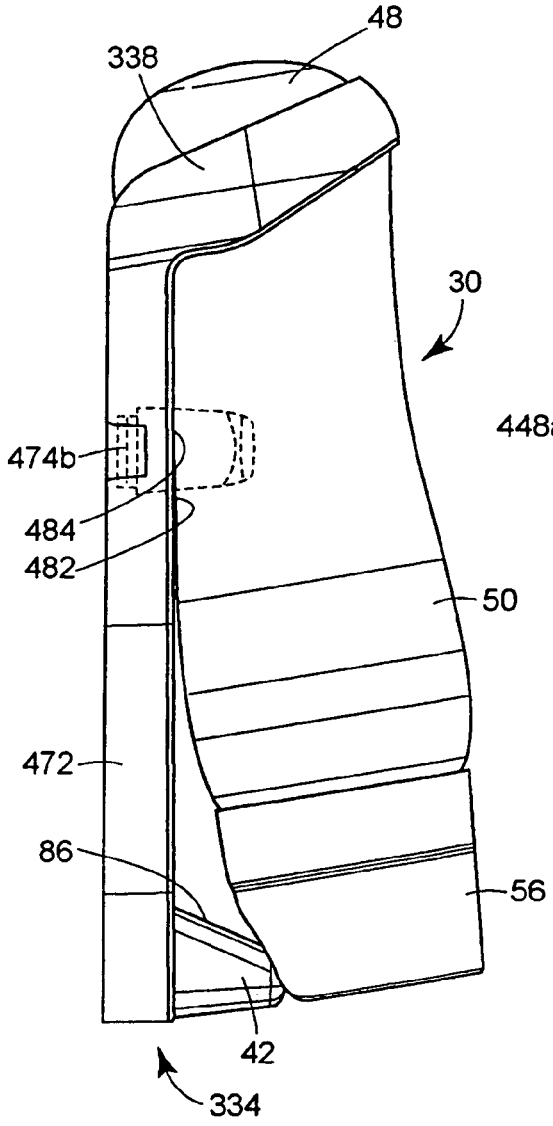
FIGS. 21 and 22 are side and rear elevational views, respectively, of the holder of FIGS. 17 and 18.
Figure 22:
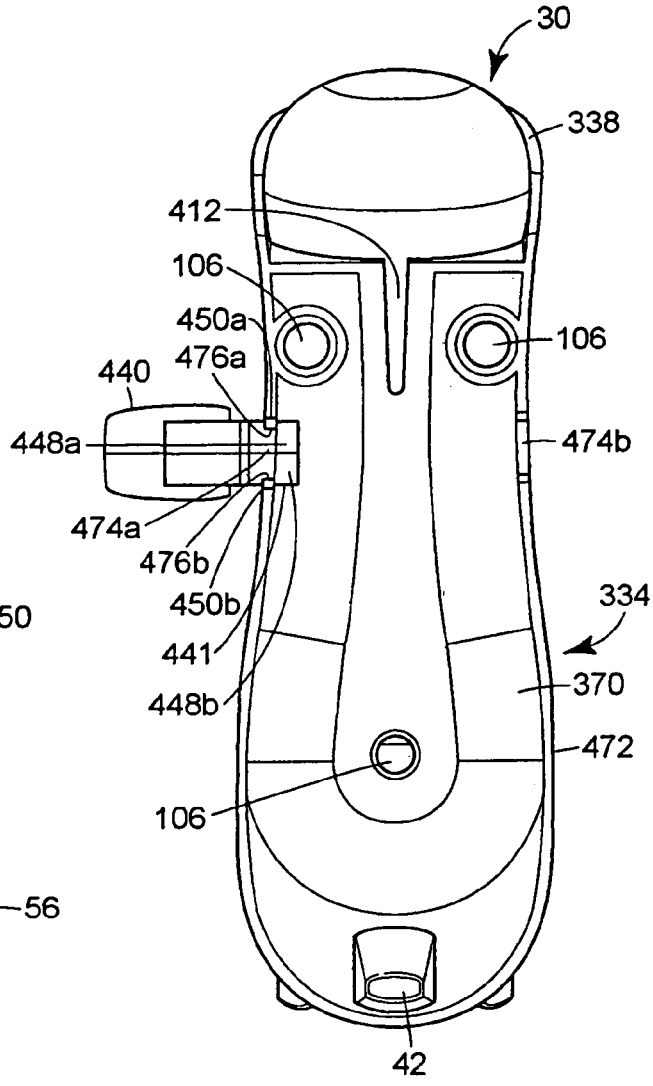

The receptacle 440 is symmetric about a midplane thereof so that the receptacle may be removed from the holder 334, turned upside down, and mounted in a second recess 474*b* disposed in the side wall 472 on a side of the holder 334 opposite the recess 474*a*, as shown by the dotted line representation of FIG. 21. Of course, one or both of the recesses 474*a*, 474*b* may be omitted and/or one or more other recesses may be formed in the side wall 472 at other location(s) to permit mounting of the receptacle 440 at such location(s).

The gripping portion 446 includes first and second arcuate legs 486*a*, 486*b* that define a circular cylindrical recess for receipt of an item, such as the razor 104. The legs 486*a*, 486*b* may be flexible, if desired, to securely grip a handle of the razor 104. In addition, the legs 486*a*, 486*b* may include inwardly directed protrusions or teeth 488 that assist in gripping the item.

With the foregoing exceptions, the holder 334 is otherwise identical to or substantially similar to the holder 234 of FIGS. 15 and 16 and functions identically thereto to hold a container for dispensing of product therefrom, such as the container 30 of FIGS. 1, 2, and 9-14.

In any of the embodiments disclosed herein, one could omit the sleeve and substitute a simple flexible and stretchable band (not shown) therefor. The band may be made of any suitable material, such as natural or synthetic rubber, and may be anchored to one or more portions of the balance of the holder and stretched over the container to restrain same.

Still further in any of the embodiments disclosed herein, one or more additional or alternative accessory receptacle(s) could be attached to or integrally formed with the holder at any suitable location thereof. In such case, each receptacle could be adapted to receive and retain an accessory such as a toothbrush, a mirror, a cloth (such as a towel or wash cloth), a comb, a hairbrush, or the like.

INDUSTRIAL APPLICABILITY

The holder of the present invention may be mounted to a wall, such as a shower wall, and used to dispense a broad variety of products, such as a shave product.

Numerous modifications to the present invention will be apparent to those skilled in the art in view of the foregoing description. Accordingly, this description is to be construed as merely exemplary of the inventive concepts taught herein and is presented for the purpose of enabling those skilled in the art to make and use the invention and to teach the best mode of carrying out same. The exclusive rights to all modifications which come within the scope of the appended claims are reserved.

We claim:

1. A holder for a container, comprising:

a wall mountable support member having a longitudinal dimension;

a holding sleeve extending transversely to the longitudinal dimension a first distance from a first region of the support member; and a foot extending transversely to the longitudinal dimension a second distance from a second region of the support member wherein the second distance is less than the first distance and wherein the foot is spaced from the holding sleeve;

wherein the holding sleeve defines a bulbous, approximately hemispherical recess; and wherein the foot is adapted to support at least some of the weight of the container.

2. The holder of claim 1, wherein the holding sleeve has a curved inner surface.

3. The holder of claim 2, wherein the holding sleeve is closed at a top portion thereof.

4. The holder of claim 3, wherein the holding sleeve comprises three wall sections separated by slits.

5. The holder of claim 1, wherein the holding sleeve is closed at a top portion thereof and wherein the holding sleeve includes two wall sections separated by a slit.

6. The holder of claim 1, further comprising a container having an outlet end and a valve, wherein the container is disposed within the holder, wherein the outlet end is pressed against the foot.

7. The holder of claim 1, further comprising a tab extending transversely to the longitudinal dimension a third distance from a third region of the support member, intermediate the first and second regions, wherein the third distance is less than the first distance.

8. The holder of claim 7, further comprising a container disposed within the holder, wherein the tab includes an arcuate ledge that engages a middle portion of the container.

9. The holder of claim 1, wherein the foot is sloped.

10. The holder of claim 1, wherein the support member is mountable to a wall.

11. The holder of claim 1, further comprising a receptacle extending from the support member.

12. The holder of claim 11, wherein the receptacle is adapted to receive a razor.

13. The holder of claim 11, wherein the receptacle is flexible.

14. The holder of claim 11, wherein the receptacle is formed by an elastomeric material.

15. The holder of claim 11, wherein the receptacle is formed by a thermoplastic rubber.

16. The holder of claim 1, further comprising a container, wherein the container is pressurized.

17. The holder of claim 1, further comprising a container, wherein the container has first and second bulbous ends.

18. A combination of a holder and a container, comprising:

a wall mountable support member having a longitudinal dimension;

a holding sleeve extending transversely to the longitudinal dimension a first distance from a first region of the support member;

a foot extending transversely to the longitudinal dimension a second distance from a second region of the support member wherein the second distance is less than the first distance and wherein the foot is spaced from the holding sleeve; and a container having an outlet valve wherein the outlet valve is adjacent to the foot, and wherein the container has an end that is received by the holding sleeve;

wherein (i) the foot is adapted to support at least some of the weight of the container, (ii) the holding sleeve has a curved inner surface adapted to receive a portion of the container, (iii) the holding sleeve is closed at a top portion thereof, and (iv) the holding sleeve comprises three wall sections separated by slits.

19. A combination of a holder and a container, comprising:

a wall mountable support member having a longitudinal dimension;

a holding sleeve extending transversely to the longitudinal dimension a first distance from a first region of the support member;

a foot extending transversely to the longitudinal dimension a second distance from a second region of the support member wherein the second distance is less than the first distance and wherein the foot is spaced from the holding sleeve; and a container having an outlet valve wherein the outlet valve is adjacent to the foot, and wherein the container has an end that is received by the holding sleeve;

wherein (i) the foot is adapted to support at least some of the weight of the container, (ii) the holding sleeve is closed at a top portion thereof, and (iii) the holding sleeve includes two wall sections separated by a slit.

20. A combination of a holder and a container, comprising:

a wall mountable support member having a longitudinal dimension;

a holding sleeve extending transversely to the longitudinal dimension a first distance from a first region of the support member;

a foot extending transversely to the longitudinal dimension a second distance from a second region of the support member wherein the second distance is less than the first distance and wherein the foot is spaced from the holding sleeve;

a container having an outlet valve wherein the outlet valve is adjacent to the foot, and wherein the container has an end that is received by the holding sleeve; and a tab extending transversely to the longitudinal dimension that is in contact with the container at a point that is a third distance from a third region of the support member and intermediate the first and second regions;

wherein (i) the foot is adapted to support at least some of the weight of the container, (ii) the tab includes an arcuate ledge that engages a middle portion of the container, and (iii) the third distance is less than the first distance.

21. A combination of a holder and a container, comprising:

a wall mountable support member having a longitudinal dimension;

a holding sleeve extending transversely to the longitudinal dimension a first distance from a first region of the support member;

a foot extending transversely to the longitudinal dimension a second distance from a second region of the support member wherein the second distance is less than the first distance and wherein the foot is spaced from the holding sleeve; and a container having an outlet valve wherein the outlet valve is adjacent to the foot, and wherein the container has an end that is received by the holding sleeve;

wherein (i) the foot is adapted to support at least some of the weight of the container and (ii) the foot is sloped.

22. A combination of a holder and a container, comprising:

a wall mountable support member having a longitudinal dimension;

a holding sleeve extending transversely to the longitudinal dimension a first distance from a first region of the support member;

a foot extending transversely to the longitudinal dimension a second distance from a second region of the support member wherein the second distance is less than the first distance and wherein the foot is spaced from the holding sleeve;

a container having an outlet valve wherein the outlet valve is adjacent to the foot, and wherein the container has an end that is received by the holding sleeve; and a receptacle extending from the support member;

wherein the foot is adapted to support at least some of the weight of the container.

23. The combination of claim 22, wherein the receptacle is adapted to receive a razor.

24. The combination of claim 23, wherein the receptacle is flexible.

25. A combination of a holder and a container, comprising:

a wall mountable support member having a longitudinal dimension;

a holding sleeve extending transversely to the longitudinal dimension a first distance from a first region of the support member;

a foot extending transversely to the longitudinal dimension a second distance from a second region of the support member wherein the second distance is less than the first distance and wherein the foot is spaced from the holding sleeve; and a container having an outlet valve wherein the outlet valve is adjacent to the foot, and wherein the container has an end that is received by the holding sleeve;

wherein (i) the foot is adapted to support at least some of the weight of the container and (ii) the holding sleeve defines a bulbous, approximately hemispherical recess.

* * * * *